US005277086A

United States Patent [19]

Hendrix

[11] Patent Number: 5,277,086

[45] Date of Patent: Jan. 11, 1994

[54] WRENCH TOOL

[76] Inventor: Danny L. Hendrix, 110 W. 20th Terrace, Oak Grove, Mo. 64075

[21] Appl. No.: 983,139

[22] Filed: Nov. 30, 1992

[51] Int. Cl.[5] ..... B25B 17/00

[52] U.S. Cl. ..... 81/57.29; 81/2; 81/57.46

[58] Field of Search ..... 81/2, 57.13, 57.29, 81/57.46

[56] References Cited

U.S. PATENT DOCUMENTS 685,544 10/1901 Weimar ..... 81/57.46 X 4,362,072 12/1982 Tillman ..... 81/57.29

4,907,476 3/1990 Singleton ..... 81/57.29

*Primary Examiner*—James G. Smith

*Attorney, Agent, or Firm*—Leon Gilden

[57] ABSTRACT

A housing member having a first housing and a second housing is arranged, with the first housing having rotary gear in cooperation with a gear shaft mounted to the second housing, with the second housing further including an hexagonal opening directed through the first housing and the first gear to translate rotary motion of the first gear to the second gear, with the first gear rotated by a wrench structure permitting access to limited geometric spacings to the tightening or selective loosening of a fastener member.

1 Claim, 6 Drawing Sheets

WRENCH TOOL

BACKGROUND OF THE INVENTION

1. Field of the Invention

The field of invention relates to tool structure, and more particularly pertains to a new and improved wrench tool permitting right angle access to a fastener in areas of limited access.

2. Description of the Prior Art

Tools of various types have been utilized throughout the prior art for access and the loosening and fastening of various tool structure, such as indicated in U.S. Pat. Nos. 4,344,339; 5,048,380; 4,898,052; and 4,794,824.

The instant invention attempts to overcome deficiencies of the prior art by permitting the access of a tool structure to an area and forum of limited geometrical spacing for the loosening and fastening of various fastener members and in this respect, the present invention substantially fulfills this need.

SUMMARY OF THE INVENTION

In view of the foregoing disadvantages inherent in the known types of wrench tool apparatus now present in the prior art, the present invention provides a wrench tool wherein the same effects the right angular translation of a first rotary motion to a second rotary motion for access to limited spacing. As such, the general purpose of the present invention, which will be described subsequently in greater detail, is to provide a new and improved wrench tool which has all the advantages of the prior art tool apparatus and none of the disadvantages.

To attain this, the present invention provides a housing member having a first housing and a second housing, with the first housing having rotary gear in cooperation with a gear shaft mounted to the second housing, with the second housing further including an hexagonal opening directed through the first housing and the first gear to translate rotary motion of the first gear to the second gear, with the first gear rotated by a wrench structure permitting access to limited geometric spacings to the tightening or selective loosening of a fastener member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wrench tool which has all the advantages of the prior art tool apparatus and none of the disadvantages.

It is another object of the present invention to provide a new and improved wrench tool which may be easily and efficiently manufactured and marketed.

It is a further object of the present invention to provide a new and improved wrench tool which is of a durable and reliable construction.

An even further object of the present invention is to provide a new and improved wrench tool which is susceptible of a low cost of manufacture with regard to both materials and labor, and which accordingly is then susceptible of low prices of sale to the consuming public, thereby making such wrench tools economically available to the buying public.

Still yet another object of the present invention is to provide a new and improved wrench tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Figure 6:
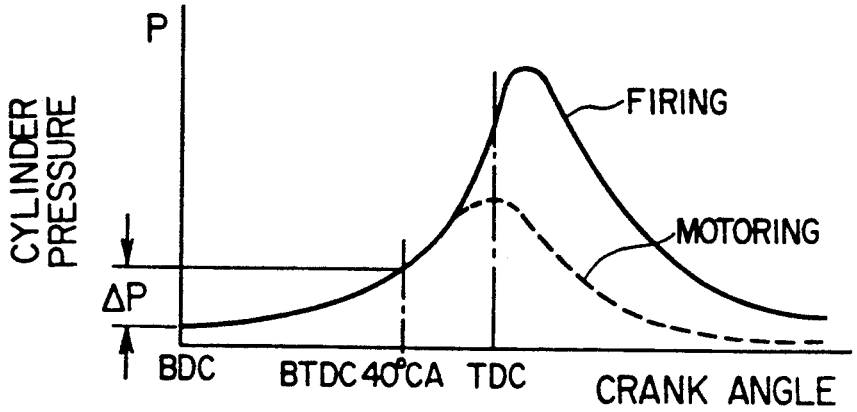
FIG. 6 is an isometric illustration of the housing member including a lubrication conduit.

FIG. **6*a* is an orthographic view, taken along the lines 6*a*—6*a* of FIG. 6** in the direction indicated by the arrows.

Figure 7:
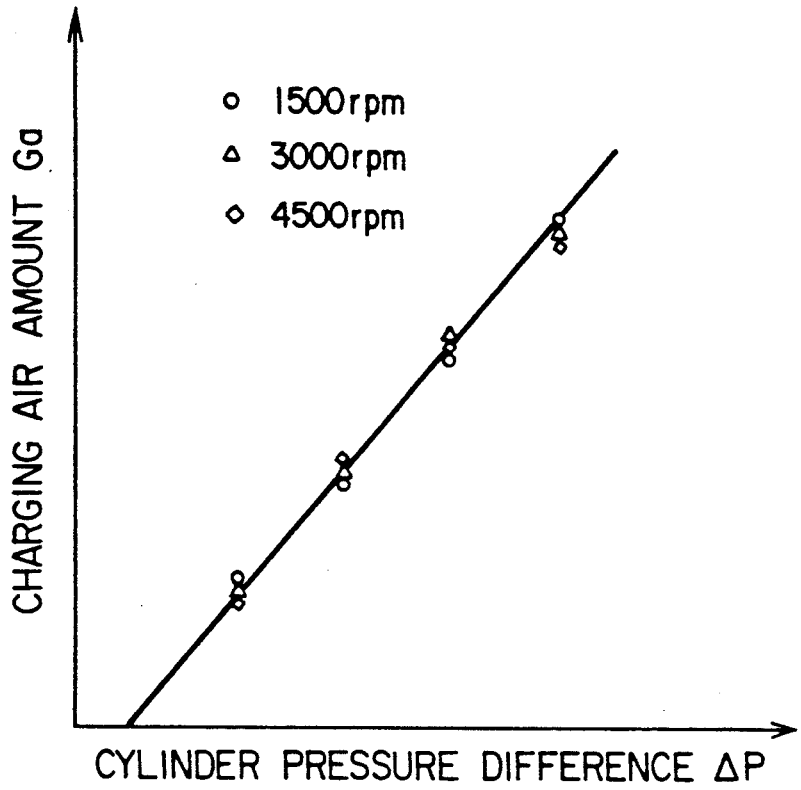
Figure 8:
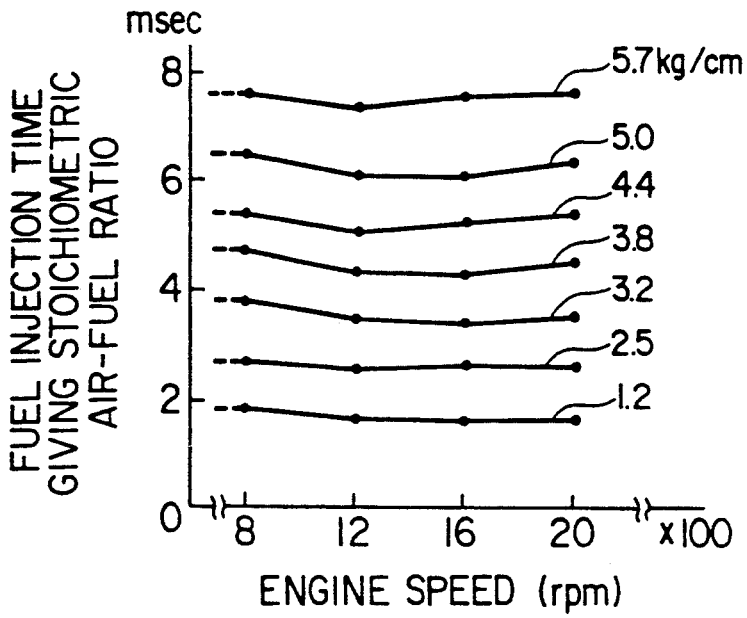
Figure 1:
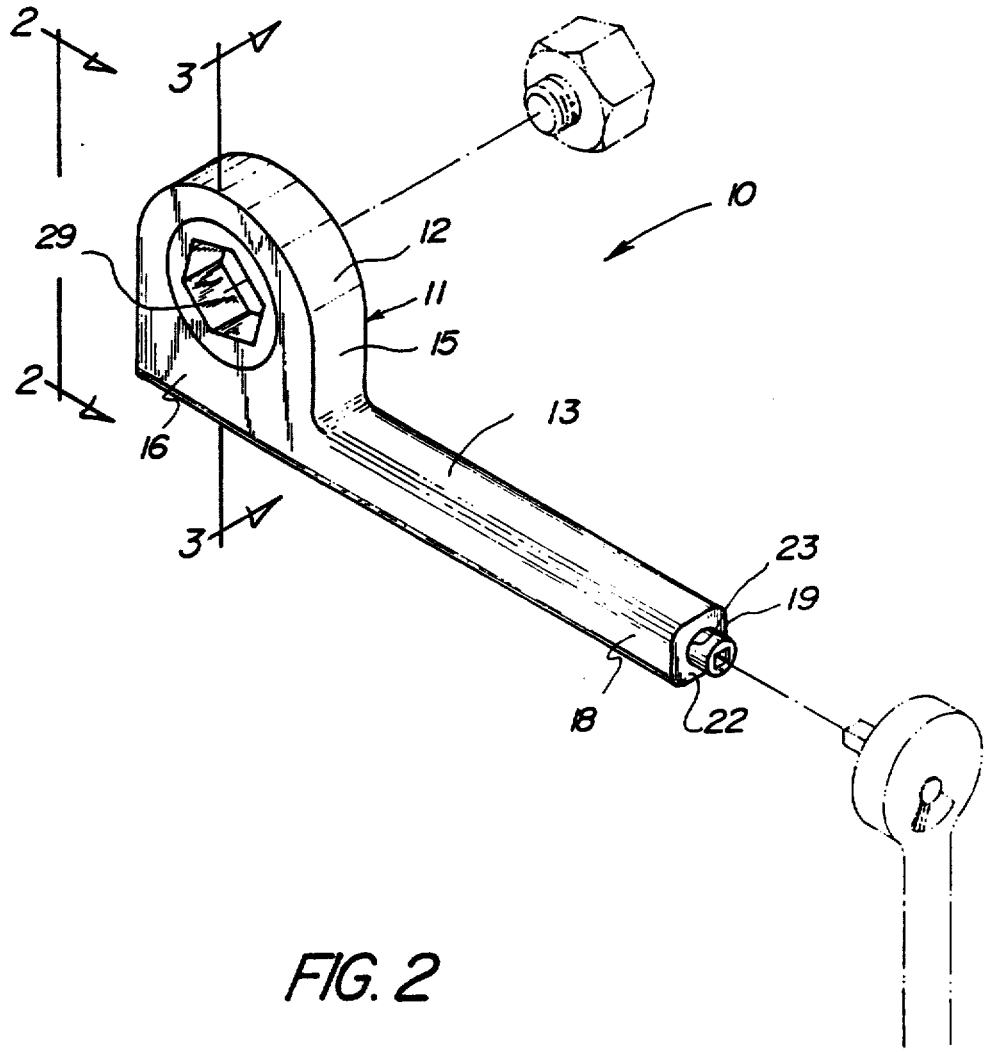
Figure 2:
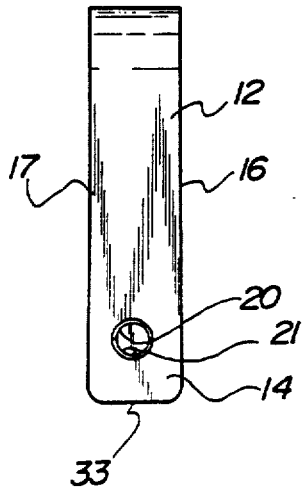
Figure 3:
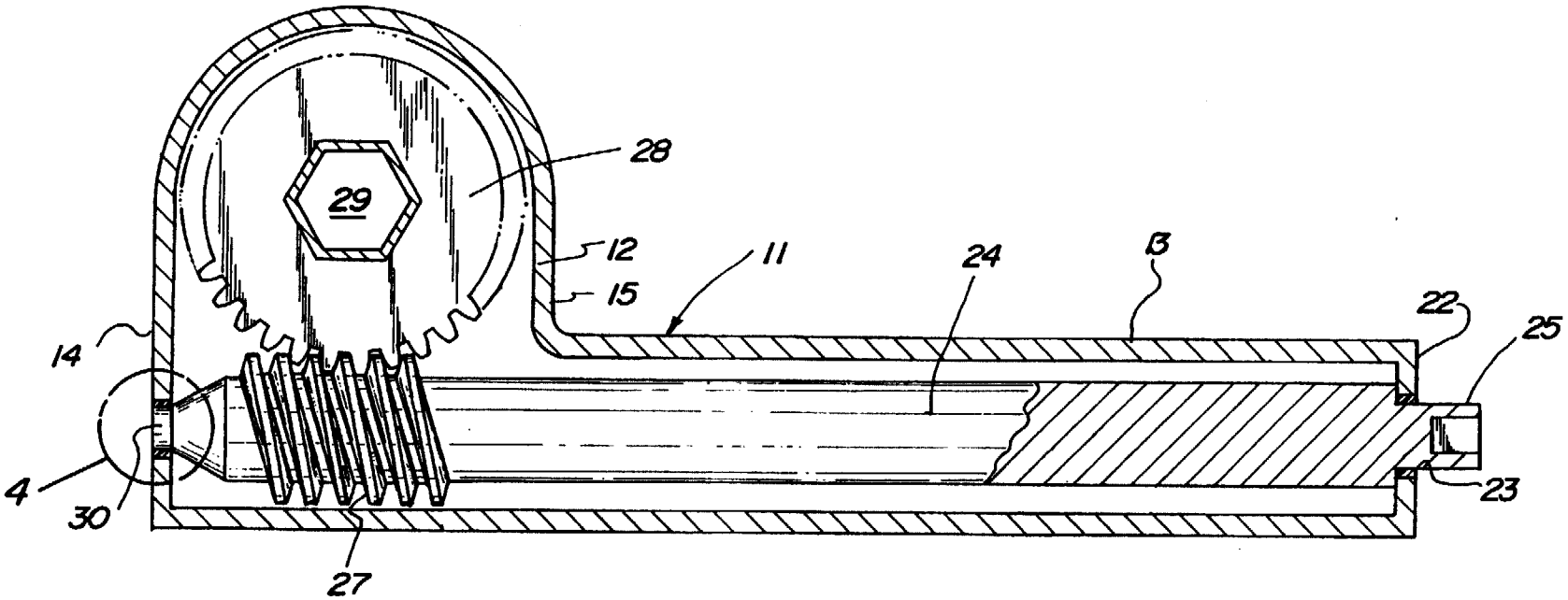
Figure 4:
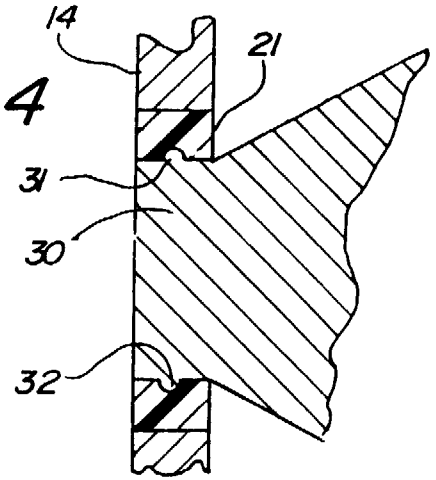
Figure 5:
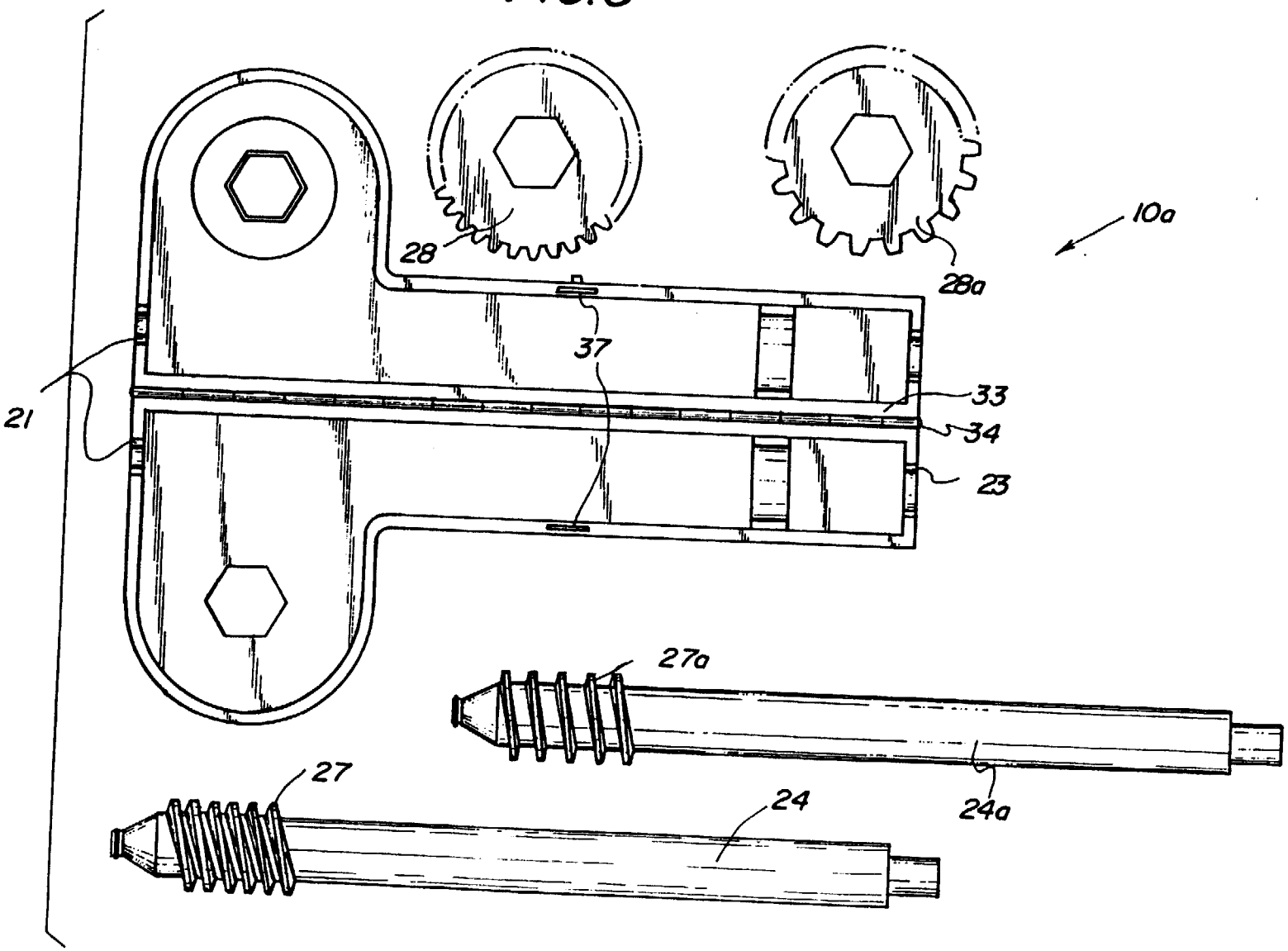
Figure 6:
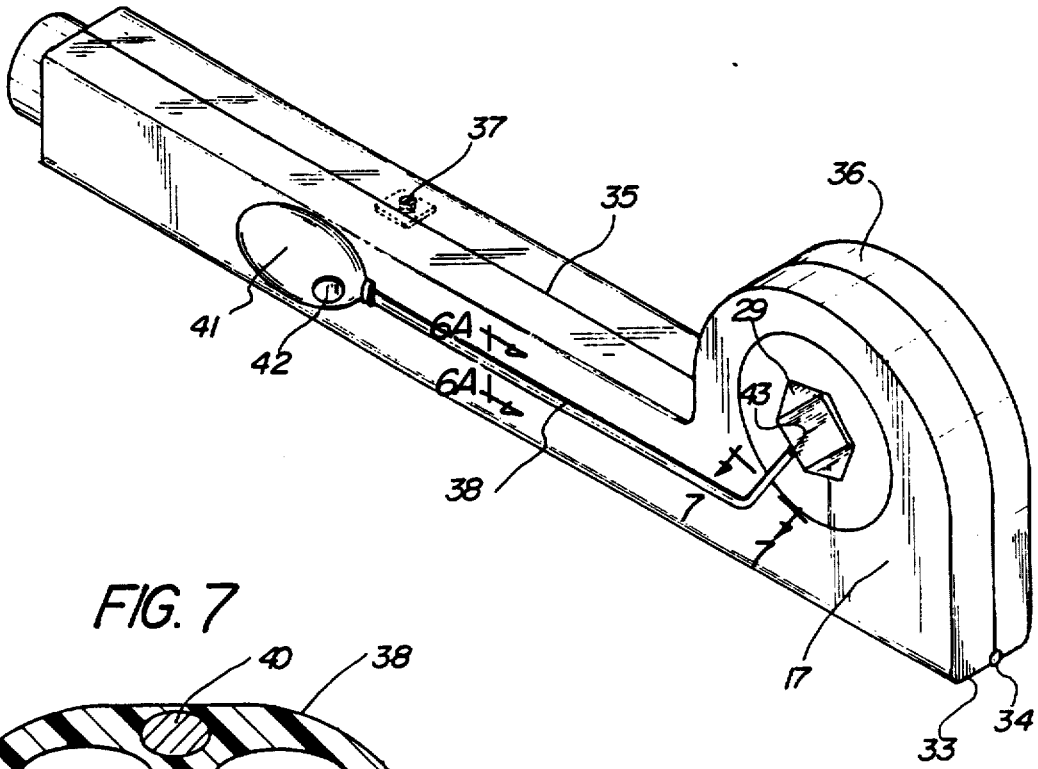
Figure 7:
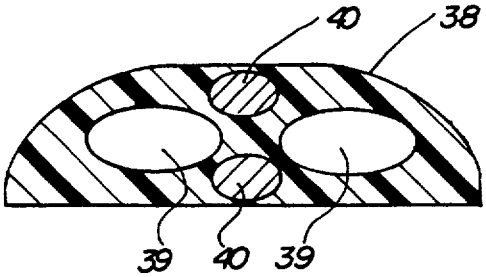
Figure 6A:
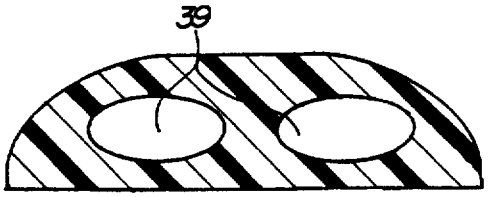

FIG. 7 is an orthographic view, taken along the lines 7—7 of FIG. 6 in the direction indicated by the arrows.

DESCRIPTION OF THE PREFERRED EMBODIMENT

With reference now to the drawings, and in particular to FIGS. 1 to 7 thereof, a new and improved wrench tool embodying the principles and concepts of the present invention and generally designated by the reference numeral 10 will be described.

Figure 1:
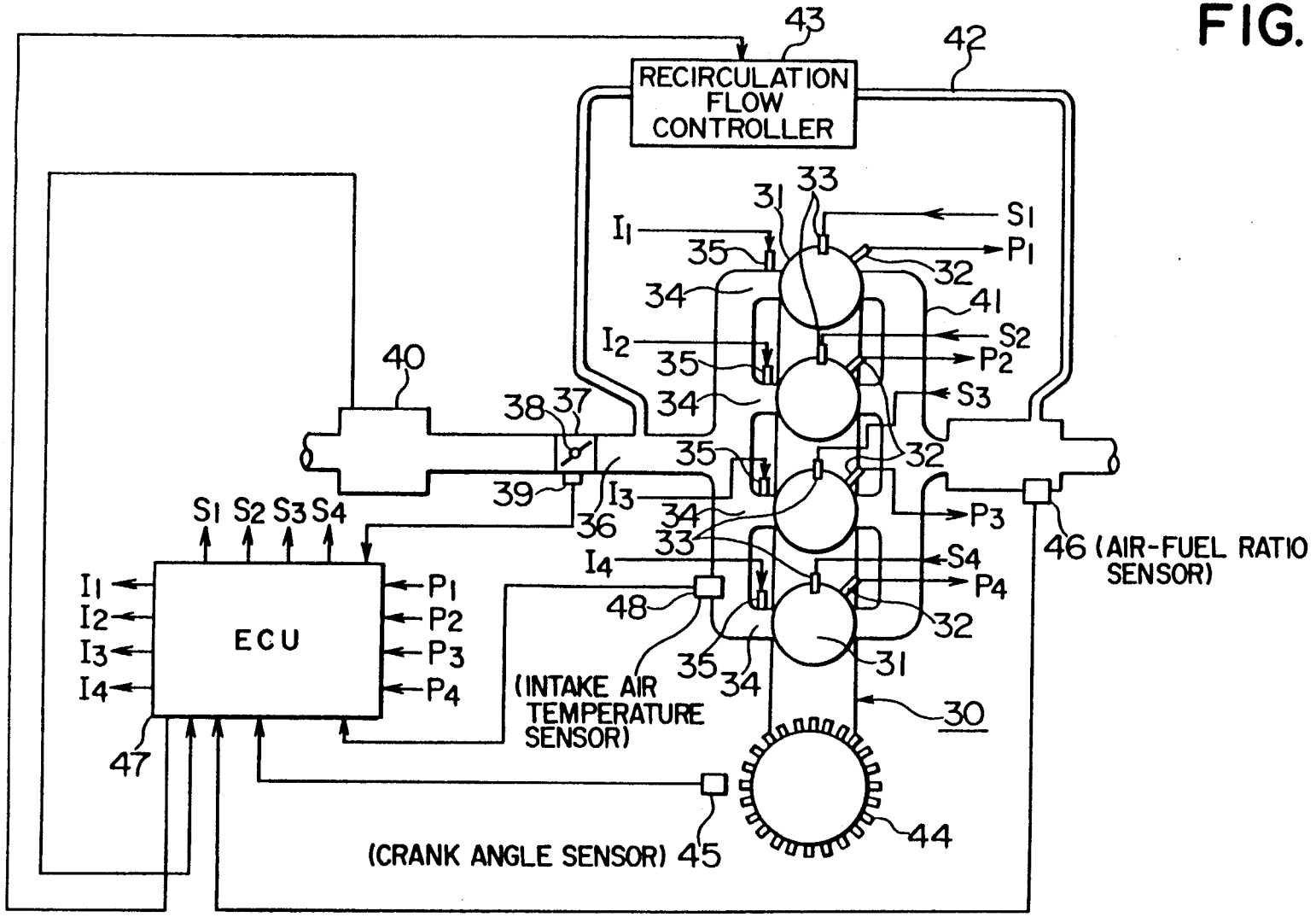
FIG. 1 is an isometric illustration of the invention.
Figure 2:
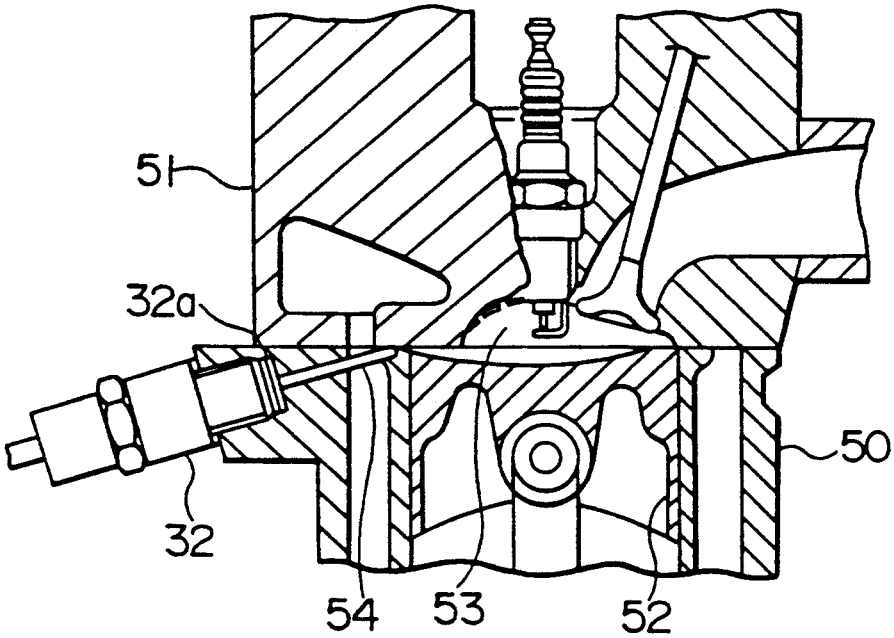
FIG. 2 is an orthographic end view of the invention, taken along the lines 2—2 of FIG. 1 in the direction indicated by the arrows.
Figure 3:
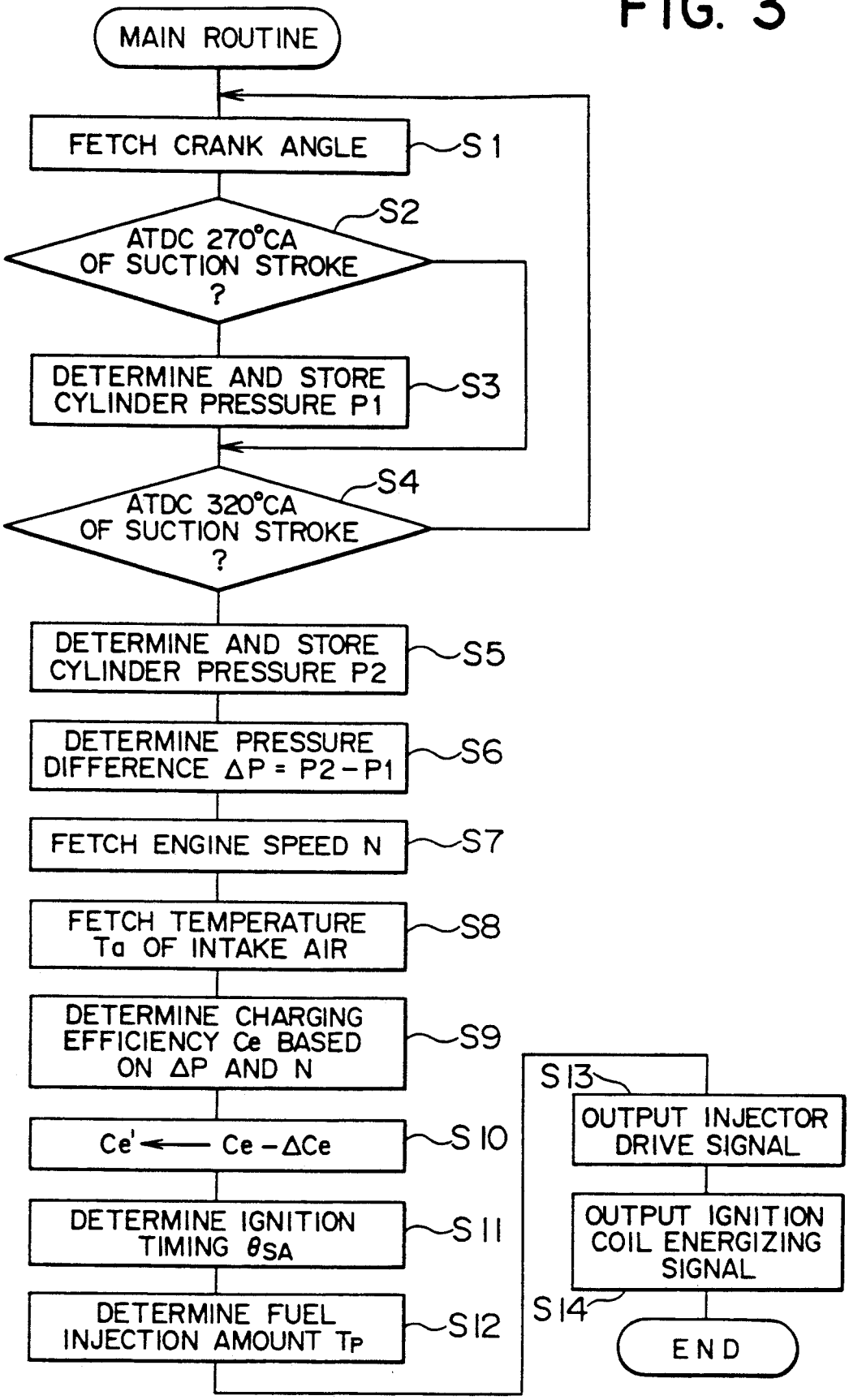
FIG. 3 is an orthographic view, taken along the lines 3—3 of FIG. 1 in the direction indicated by the arrows.

More specifically, the wrench tool 10 of the instant invention essentially comprises a housing member 11, to include a first housing portion 12 and a second housing tubular portion 13. The first housing portion 12 includes a first housing first end wall 14 spaced from a first housing second end wall 15, and having first housing first and second side walls 16 and 17 respectively, with an hexagonal bore structure 29 orthogonally directed through the first housing first and second side walls 16 and 17. The housing tubular portion 13 includes the second housing tube first and second side walls 18 and 19 that are respectively coplanar with the first housing first and second side walls 16 and 17. A first bore 20 is directed through the first housing first end wall 14 in adjacency to the floor 33. A cylindrical split busing 21 that is diametrically split is directed through the first bore 20 and is coaxially aligned with the tubular second housing end wall 22 that includes a second housing bore 23 coaxially aligned with the first bore 20. A gear shaft 24 is rotatably mounted and extends coextensively between the second housing bore 23 and the first bore 20, with a first gear 27 mounted about the gear shaft 24 within the first housing portion 12. The gear shaft 24 includes a first stub shaft 25 rotatably directed through the second housing bore 23 and with the first stub shaft 25 formed with a stub shaft socket to receive a wrench member, as indicated in FIG. 1. The first gear 27 is arranged in operative engagement with a second gear 28 within the first housing portion 12. The hex bore 29 is coaxially directed through the second gear 28 orthogonally oriented relative to the gear shaft 24. The gear shaft 24 further includes a gear shaft second stub shaft 30 coaxially aligned with the first stub shaft 25, with the second stub shaft 30 directed rotatably through the split bushing 21.

Figure 4:
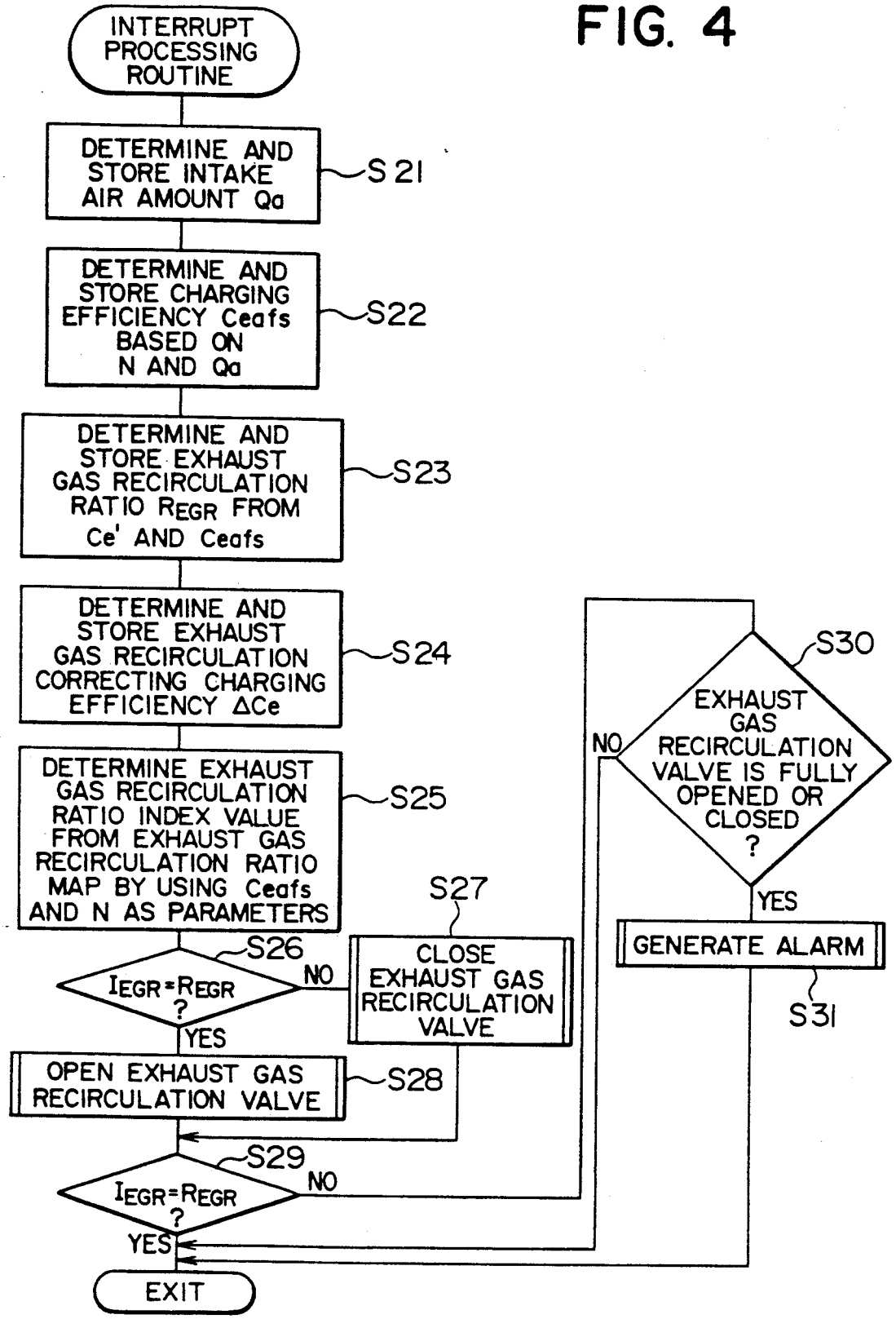
FIG. 4 is an enlarged orthographic view of section 4 as set forth in FIG. 3.

Reference to FIG. 4 indicates the split bushing structure 21 having a bushing groove 32 coaxially aligned with the gear shaft 24, with the groove 32 arranged to accommodate a stub shaft ring 31 of the second stub shaft 30 to maintain orientation of the gear shaft within the housing member 11.

Figure 5:
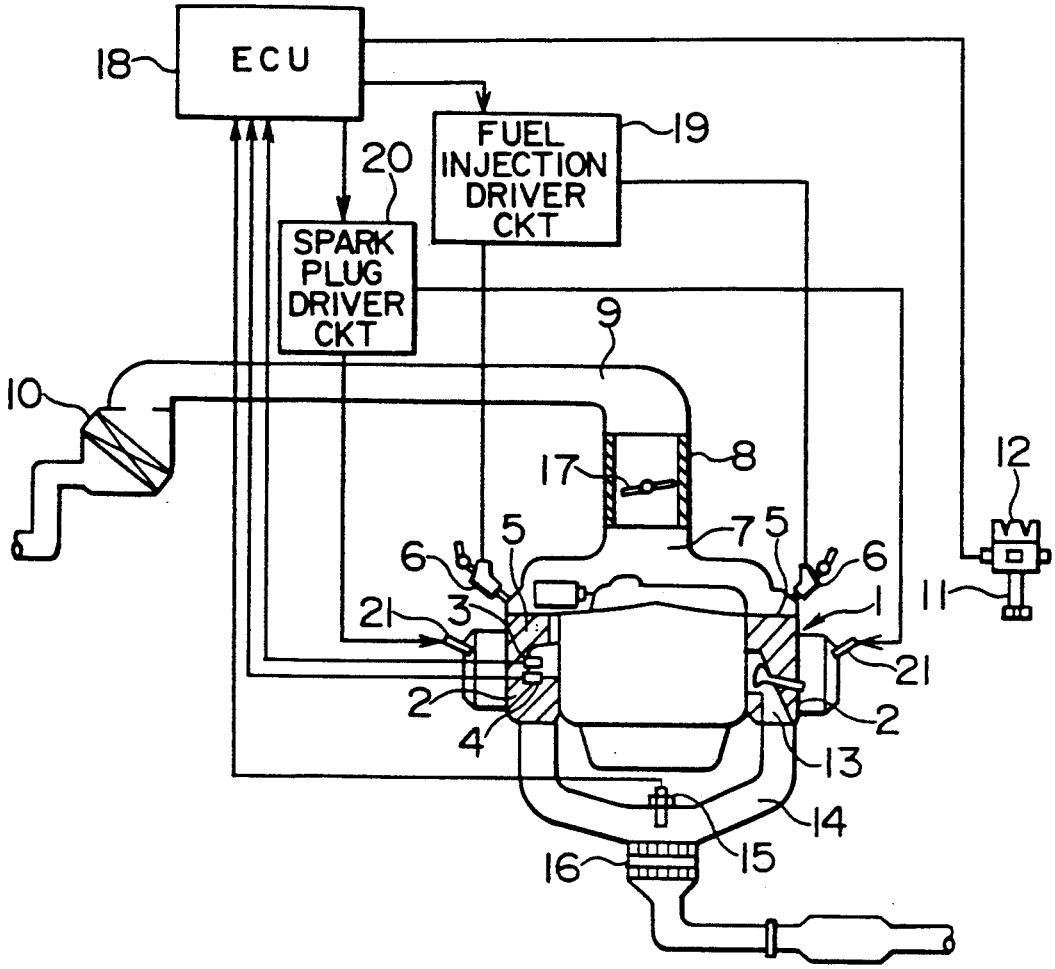
FIG. 5 is an orthographic view of a modified housing member construction of the invention.

The FIG. 5 indicates a modified housing portion structure having an elongate hinge 34 directed medially and coextensively of the housing member floor 33 to permit opening of the housing portion into a first and second portion latched together by means of a latch 37. In this manner, modified gear shaft **24*a*, with a modified first gear 27*a*, is selectively mounted within the modified housing portion for cooperation with a modified second gear 28*a*** permitting various torque applications to a fastener.

The FIG. 6 further indicates the optional use of the mounting of a fluid delivery tube 38 along the housing portion, having at least one, and preferably a plurality of, fluid conduits 39. Directional wires 40 are malleable and mounted within the delivery tube 38 along the first housing's second side wall 17 permitting orientation of the delivery tube outlet end 43 towards a fastener. A squeeze bulb 41 is provided at an entrance end of the fluid delivery tube 38 to direct various fluid, such as lubricants, penetrating fluids, and the like to a fastener to assist in its loosening and tightening. The squeeze bulb 41 includes a fill cap 42 to provide for selective replenishment of such fluid within the squeeze bulb.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wrench tool, comprising, a housing member, the housing member having a first housing portion and a second housing portion, with the second housing portion intersecting the first housing portion, and the second housing portion of a tubular configuration, and wherein the first housing portion includes a first housing first end wall spaced from a first housing second end wall, and a first housing first side wall spaced from a first housing second side wall, with the second housing tubular portion intersecting and directed through the first housing second end wall, and the second housing tubular portion including a second housing first side wall coplanar with the first housing first side wall, and a second housing second side wall coplanar with the first housing second side wall, and the housing member having a floor, the floor coextensive with the first housing portion and the second housing tubular portion, and a first bore directed through the first housing first end wall in adjacency to and parallel the floor, and the second housing tubular portion having a second housing end wall, with the second housing end wall having a second housing bore coaxially aligned with the first bore, and a gear shaft directed form the first bore to the second housing bore, with the gear shaft having a first gear, and a second gear mounted within the first housing portion cooperative with the first gear, and a hex bore coaxially directed through the second gear, and the hex bore orthogonally oriented relative to the gear shaft and directed through the first housing first side wall and the first housing second side wall, whereupon rotation of the gear shaft effects rotation of the second gear, and the first bore includes a split bushing, and the second housing bore includes a second split bushing, and the gear shaft includes a first stub shaft directed through the second housing bore split bushing, and a second stub shaft directed through the first bore, with the second stub shaft having a second stub shaft ring projecting radially beyond the second stub shaft, and the first split bushing having a groove receiving the ring therewithin for maintaining alignment of the gear shaft within the housing member, and the floor, the first housing portion, and the second housing tubular portion are split to define a first housing half and a second housing half, with a hinge coextensive of the floor and medially thereof to pivotally mount the first housing half to the second housing half, and a lock member mounted to the first housing half and the second housing half to selectively secure the first housing half to the second housing half permitting replacement of the gear shaft and the second gear.

* * * * *

UNITED STATES PATENT AND TRADEMARK OFFICE

CERTIFICATE OF CORRECTION

PATENT NO. : 5,277,086

DATED : January 11, 1994

INVENTOR(S) : Danny L. Hendrix

It is certified that error appears in the above-indentified patent and that said Letters Patent is hereby corrected as shown below:

The title page showing the ilustrative Figure should be deleted to be replaced with the attached title page.

In the drawings, Sheets 1-6, consisting of Figs. 1-8, should be deleted to be replaced with Sheets 1-4, as shown on the attached pages.

Signed and Sealed this

Twenty-fifth Day of October, 1994

*Attest:*

Bruce Lehman

BRUCE LEHMAN

*Attesting Officer*

*Commissioner of Patents and Trademarks*

United States Patent [19]

Hendrix

[11] Patent Number: 5,277,086

[45] Date of Patent: Jan. 11, 1994

[54] WRENCH TOOL

[76] Inventor: Danny L. Hendrix, 110 W. 20th Terrace, Oak Grove, Mo. 64075

[21] Appl. No.: 983,139

[22] Filed: Nov. 30, 1992

[51] Int. Cl.[5] ..... B25B 17/00

[52] U.S. Cl. ..... 81/57.29; 81/2; 81/57.46

[58] Field of Search ..... 81/2, 57.13, 57.29, 81/57.46

[56] References Cited

U.S. PATENT DOCUMENTS 685,544 10/1901 Weimar ..... 81/57.46 X 4,362,072 12/1982 Tillman ..... 81/57.29

4,907,476 3/1990 Singleton ..... 81/57.29

*Primary Examiner*—James G. Smith

*Attorney, Agent, or Firm*—Leon Gilden

[57] ABSTRACT

A housing member having a first housing and a second housing is arranged, with the first housing having rotary gear in cooperation with a gear shaft mounted to the second housing, with the second housing further including an hexagonal opening directed through the first housing and the first gear to translate rotary motion of the first gear to the second gear, with the first gear rotated by a wrench structure permitting access to limited geometric spacings to the tightening or selective loosening of a fastener member.

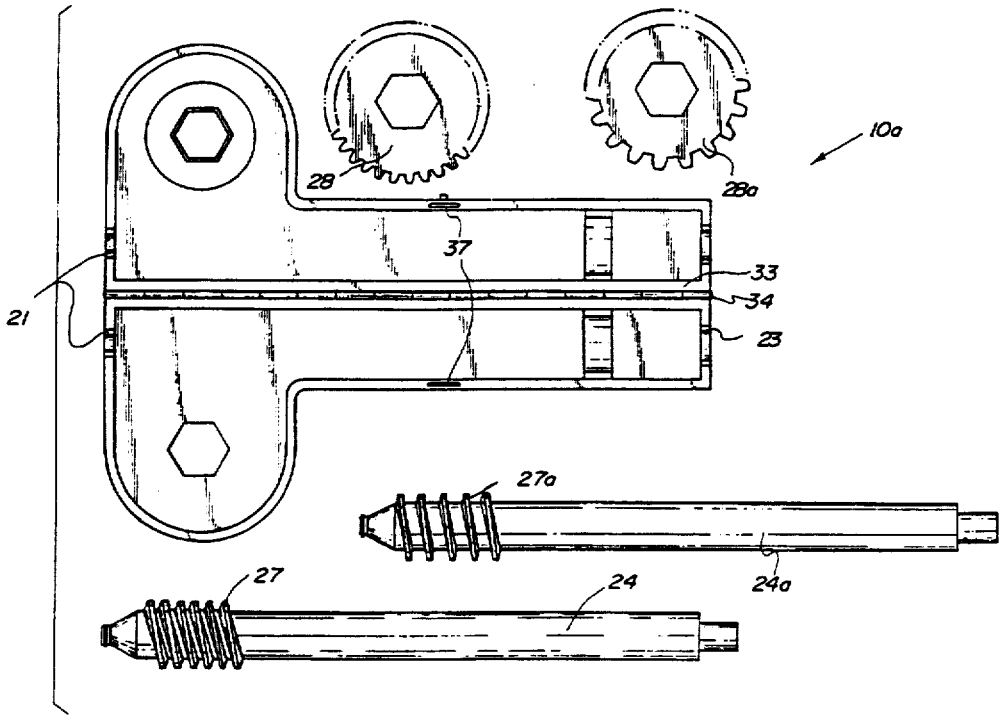

1 Claim, 4 Drawing Sheets